US005248328A

United States Patent [19]

He et al.

[11] Patent Number: 5,248,328

[45] Date of Patent: Sep. 28, 1993

[54] PROCESS FOR PREPARING RARE EARTH CONTAINING HARD ALLOY

[75] Inventors: Congxun He; Chenguang Lin; Youming Wang; Yunhua Shi, all of Beijing, China

[73] Assignee: General Research Institute For Non-Ferrous Metals, Beijing, China

[21] Appl. No.: 730,678

[22] Filed: Jul. 16, 1991

[30] Foreign Application Priority Data

Jul. 18, 1990 [CN] China ..... 90 1 04587.X

[51] Int. Cl.[5] ..... C22C 29/08

[52] U.S. Cl. ..... 75/352; 75/359; 419/18; 423/21.1; 423/440

[58] Field of Search ..... 75/352, 359, 368; 423/21.1, 440; 419/15, 18

[56] References Cited

U.S. PATENT DOCUMENTS

| | | | |
|---|---|---|---|
| 3,515,540 | 6/1970 | Meadows | 75/359 |
| 4,872,904 | 10/1989 | Dorfman | 75/352 |
| 4,902,471 | 2/1990 | Penkunas et al. | 75/352 |
| 4,923,512 | 5/1990 | Timm et al. | 419/18 |
| 4,965,044 | 10/1990 | Miyamoto et al. | 419/18 |

FOREIGN PATENT DOCUMENTS

| | | | |
|---|---|---|---|
| 891057080 | 11/1989 | China . | |
| 455529 | 11/1991 | European Pat. Off. | 423/21.1 |
| 3228692 | 7/1984 | Fed. Rep. of Germany . | |
| 183439 | 8/1986 | Japan . | |
| 433665 | 8/1967 | United Kingdom . | |

*Primary Examiner*—George Wyszomierski

*Attorney, Agent, or Firm*—Charles Berman; Sarah Adriano

[57] ABSTRACT

This invention discloses a process for preparing rare earth containing hard alloy, comprising preparing metal carbide powder containing rare earth metals or cobalt powder containing rare earth metals by using wet co-precipitating method; according to the composition of alloy, at least one kind of the metal carbide powder containing rare earth metal and cobalt powder containing rare metals being mixed homogeneously with other raw materials, shaping and finally sintering under high temperature. The process of the invention is simple technologically. The properties of the products produced by the process of the invention are good, stable and repeatable.

9 Claims, 4 Drawing Sheets

PROCESS FOR PREPARING RARE EARTH CONTAINING HARD ALLOY

FIELD OF THE INVENTION

This invention relates to a process for preparing rare earth containing hard alloy, especially relates to a process for preparing tungsten carbide based rare earth containing hard alloy.

BACKGROUND OF THE INVENTION

Hard alloy with exceedingly good comprehensive properties is used for making cutting tool, mould, drilling tools, and other wear-resistant and shock resistant parts for machinery, electronics, chemical industry, petroleum, geological prospecting, etc. Rare earth metals containing hard alloys are tough, oxidation resistant, shock resistant, and strong under high temperature.

A good deal of attention has been paid to the development of this material. The rare earth containing hard alloy is conventionally prepared by powder metallurgy, in which the powders of raw materials are mixed and milled according to a required composition, followed by drying, shaping by pressing, and sintering to produce hard alloy having a required shape. DE 3,228,692, Japan Patent Application 59-43,840,61-183,429, and China Patent Application CN 89,105,708 disclosed several processes for preparing rare earth containing hard alloy, in which the powder of rare earth metals, the powder of rare earth oxides and the powder of nitride were used as raw materials and were mixed directly with the powders of carbides and other materials to make rare earth metal containing hard alloy. The property of the rare earth metal containing hard alloy thus prepared was improved to a certain extent as compared to the hard alloy without rare earth metals. However, the disadvantages of the prior art are as follows. First instability of the alloy property. The incorporation of the rare earth metals by above mentioned processes applies more strict demands to the technology of alloy preparation. The rare earth metals may exist in the alloy in a state of bulky rare earth phase such as lump, pieces with multiangles, etc. The bulky rare earth metal phase occludes with the alloy, which diminishes the effect of the rare earth and causes the instability of the product. Second, the preparation of different alloy series with different composition (including mainly WC—Co, WC—TiC—Co, and WC—TiC—TaC—(NbC)—Co series) and the quantity of the rare earth metals incorporated into the hard alloy, all require the optimization of the parameters in preparation procedure of such alloys. Hence, the preparation technology becomes too complicated to commercialize. The above listed disadvantages limit the production and application of rare earth containing hard alloy in a wider range.

OBJECTS OF THE INVENTION

One object of the invention is to overcome the disadvantages in the prior art and to provide a process for preparing rare earth containing hard alloy which is simple and broadly applicable.

Another object of the invention is to provide a process for preparing a rare earth containing hard alloy, the product of which possesses exceedingly good property, stability, and long service life.

SUMMARY OF THE INVENTION

The process of the invention for preparing rare earth metal containing hard alloy comprises: mixing homogeneously a solution of a soluble cobalt salt or powder of a metal carbide with a solution of a soluble rare earth metal salt for wet coprecipitation process, adding to the mixture a solution of a precipitator to obtain a mixture of the precipitate of the rare earth metal salt and the precipitate of cobalt salt, or a mixture of the precipitate of the rare earth metal salt and the powder of the metal carbide, reducing under high temperature in hydrogen the precipitate of the cobalt salt and the precipitate of the rare earth metal salt into their metals to obtain the mixture of the powder of the metal carbide and the powder of the rare earth metal or the mixture of the powder of cobalt and the powder of the rare earth metal, followed by burdening according to the required alloy composition and milling, adding to the powder mixture an organic forming agent, or not adding it, shaping by pressing, eliminating the forming agent under vacuum or in the reducing gas or in inert gas, finally sintering under high temperature to obtain the rare earth containing hard alloy.

According to the process of the invention, the rare earth metals selected comprise Ce, Y, La, Sm, Pr, Nd, or the mixture thereof; said soluble salts comprise nitrates and chlorides; said precipitator comprises oxalic acid, ammonium oxalate, or sodium carbonate.

DETAILED DESCRIPTION OF THE INVENTION

Figure 1:
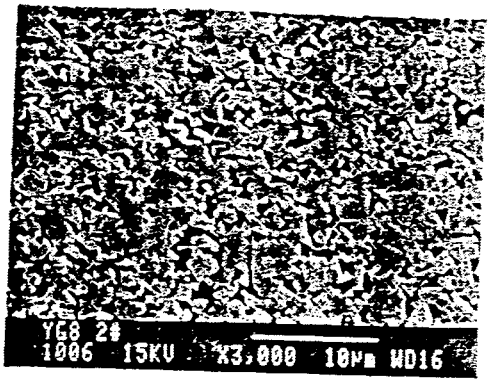
FIG. 1 is the morphology of the alloy prepared in Example 1 observed by SEM.

The process of the invention for preparing rare earth containing hard alloy comprises following steps;

a. mixing homogeneously a solution of a soluble rare earth metal salt with a metal carbide powder or a solution of a soluble cobalt salt, adding to the mixture, while heating, a precipitator solution, resulting in a mixture of the metal carbide powder and the precipitate of the rare earth metal salt or a mixture of the precipitate of the cobalt salt and the precipitate of the rare earth metal salt, filtrating the mixture after reaction, washing the filtrate by distilled water or deionized water followed by drying, reducing said precipitates of the cobalt salt and the rare earth metal salt in hydrogen under high temperature, crushing and sieving for making a metal carbide powder containing rare earth metals or a cobalt powder containing rare earth metals;

b. mixing and milling homogeneously, according to the composition of the alloy, the powders of metal carbide and cobalt and other raw materials, wherein at least one kind of powder from said metal carbide powder and cobalt powder being the kind of powder containing rare earth metal prepared according to step a;

c. shaping by pressing the mixture obtained from steb b with or without adding organic forming agent, followed by treating under high temperature under vacuum or in reducing gas or in inert gas to eliminate the forming agent, sintering the mixture under high temperature after forming agent elimination and obtaining rare earth containing hard alloy products.

According to the process of the invention, said procedure of forming by pressing can be any of known forming method, such as cold pressing, hot pressing, cold static pressing, injecting extruding, etc., said organic-forming agents include wax, rubber, PEG, PVA, methyl cellulose, etc.

According to the process of the invention, said rare earth metals comprise Cc, Y, Sm, La, Pr, Nd, or the mixture of two or more than two of these metals, said soluble rare earth metal salt and cobalt salt comprise their nitrates and chlorides, said precipitator comprises oxalic acid, ammonium oxalate, and sodium carbonate.

The metal carbide used in the process of the invention is tungsten carbide, to which TiC, TaC, NdC, ZrC, HiC, CrC, (W, Ti)C, and VC may be further added.

The cobalt powder is used int he process of the invention as the binder phase, other powder of the iron group elements may also be used as the binder phase, such as the powder of nickel and iron.

According to one embodiment of the present invention, the cobalt powder containing rare earth metals is prepared in advance of the preparation of the rare earth containing hard alloy by following method;

A solution of a soluble cobalt salt is mixed homogeneously with a solution of a soluble rare earth metal salt in a given proportion. The solution mixture is heated to 30°-90° C., followed by adding a precipitator solution to it while stirring. The quantity of the precipitator added is 1.0-2.0 mole equivalent per mole equivalent rare earth metal salt. After reaction, the mother liquid is removed in a vacuum filtrator. The filtrate is washed by distilled water or deionized water of a temperature in the range of 80°-100° C. for several times and dried at 100°-210° C. and crushed, then reduced at 450°-750° C. in hydrogen to transform the precipitates of cobalt salt and rare earth metal salt into metals. The cobalt powder containing rare earth metal is thus obtained.

The prepared cobalt powder containing rare earth metal is mixed homogeneously with the carbide powder or the carbide powder containing rare earth metal, milled, then used to prepare the rare earth containing hard alloy by above-mentioned method.

According to the process of the invention, during the reaction process of the solution of the soluble rare earth metal salt and the soluble cobalt salt with the precipitator solution, the concentration of the reactants and the reaction temperature strongly influence the crystal nucleus size of the product (precipitate) and the homogeneity of the particle size. Generally speaking, the rate of the crystal nucleus formation of the product is proportional to the concentration of the reactant solution, i.e., the rate of the nucleus formation and the precipitation increases, the particle size decreases, with the increase of the reactant concentration. However, a too high reactant concentration will cause a broad distribution of the product particle size, and a too low reactant concentration will cause large product particle size. In the process of the invention, the concentration of the soluble cobalt salt and the precipitator is controlled by the specific gravity of their solution. The specific gravity of the solution of the soluble salt is controlled in the range of 1.05-1.40 g/cm$^3$, and that of the precipitator solution in the range of 1.03-1.20 g/cm$^3$. Since the solution of the soluble rare earth metal salt is only used in small quantity, its concentration is not limited.

During the reaction process, the growing rate of the crystal nucleus also depends on the reaction temperature: higher reaction temperature will lead to large particle size of the reaction product, whereas lower reaction temperature will lead to a broad distribution of the product particle size. The reaction temperature for precipitation is usually controlled in the range of 30°-90° C. After reaction, the precipitate is washed by distilled water or deionized water for 4-6 times. According to the required particle size of the product, the precipitate after washing and drying and the metals obtained from reducing may or may not be further crushed and sieved.

According to another embodiment of the present invention, the powder of the metal carbide containing rare earth metals is prepared in advance of the preparation rare earth containing hard alloy by following method:

The powder of the metal carbide is mixed homogeneously with a solution of a soluble rare earth metal salt in a given volume proportion. The mixture is heated to a temperature in the range of 30°-45° C. A precipitator solution is added while stirring. The precipitate of the rare earth metal salt is obtained through the reaction. After filtration, the filtrate including the carbide powder and the precipitate is washed by distilled water or deionized water for several times, drying, reducing at 700°-800° C. in hydrogen to obtain the powder of the metal carbide containing rare earth metals.

The prepared powder of the metal carbide containing rare earth metals is mixed homogeneously with the cobalt powder or the cobalt powder containing rare earth metals, milled, then is used to prepare the rare earth containing hard alloy by the above-mentioned method.

According to the process of the invention, the quantity of the precipitator used is 1.0-2.0 mole equivalent per mole equivalent of soluble cobalt salt and soluble rare earth metal salt.

The invention also concerns the rare earth containing hard alloy prepared by the process of the invention. Said alloy possesses high bending strength and good shock resistance. The cutting tools made of said alloy have longer service life.

The rare earth metal elements in the rare earth containing hard alloy prepared by the process of the invention partly exist in the binder phase, partly exist homogeneously in the alloy as microspheres of rare earth metal having a particle size less than 0.5 μm. The property of the alloy is exceedingly good and stable.

The present invention is further described with the reference of the following Examples.

EXAMPLE 1

The raw materials of the sample were WC powder and Co powder from market. A solution of cobalt nitrate having a gravity of 1.15 g/cm$^3$ was mixed homogeneously with a solution of yttrium chloride having a concentration of 67 g/l in a volume proportion of 210:1. The mixed solution was heated to 90° C. A solution of ammonium oxalate having a gravity of 1.03 g/ml and pH 5.5 was added to it while stirring. The quantity of ammonium oxalate added was 1.5 mole equivalent per mole equivalent of cobalt nitrate and yttrium chloride. The precipitate obtained from the reaction was filtrated in a vacuum filtrator to remove the mother liquid. The filtrate was washed by deionized water of 90° C. for 7 times, dried at 160° C., then reduced at 500° C. in hydrogen for 4 h. The reduced product was crushed and sieved by a 100 mesh sieve. The cobalt powder thus prepared contained 4.2% (wt.) rare earth yttrium.

The prepared yttrium containing cobalt powder was mixed homogeneously with WC powder and Co powder according to following composition: WC 91.94% (wt.), Co 8% (wt.), and Y 0.06% (wt.). The mixture was milled in a ball mill for 36 h, followed by adding 2% (on the basis of the total mixture weight) wax forming agent, shaping by cold pressing, treating at 550° C. in hydrogen to remove wax, and sintering at 1410±10° C. for 45 minutes to obtain yttrium containing hard alloy.

According to the method described above, 5 batches of yttrium containing hard alloy were prepared. Their bending strength are listed in Table 1.

TABLE 1

Bending strength of Y- containing hard alloy

| | Batch No. | | | | |
|---|---|---|---|---|---|
| | 1 | 2 | 3 | 4 | 5 |
| Bending strength, MPa | 2542 | 2508 | 2477 | 2730 | 2638 |
| Average value | | 2579 | | | |

Table 1 shows that the bending strength, as one of the product properties, of the yttrium containing hard alloy is stable from batch to batch.

The prepared yttrium containing hard alloy was observed by scanning transmission electron microscope. The results show that the rare earth yttrium exists in a separate microspheres phase having a particle size less than 0.5 μm except a slight amount forming micro-solid solution in the binder phase of cobalt. This explains the stability of the product property.

EXAMPLE 2

The raw materials were the powder of WC, the powder of Co, and the powder of (Ti, W)C solid solution, obtained from market.

A solution of cobalt nitrate having a gravity of 1.30 g/cm$^3$ was mixed homogeneously with a solution of yttrium chloride having a concentration of 67 g/l in a volume proportion of 520:1. The mixed solution was heated to 60° C. A solution of ammonium oxalate having a gravity of 1.06 g/cm$^3$ and a pH 2.5 was added while stirring. The quantity of ammonium oxalate added was 1.5 mole equivalent per mole equivalent of cobalt nitrate and yttrium chloride. The precipitate of cobalt oxalate and yttrium oxalate was obtained after reaction and filtrated in a vacuum filtrator to remove mother liquid. The filtrate was washed by distilled water of 100° C. for 5 times, dried at 150° C., crushed and sieved by a 40 mesh sieve, reduced at 450° C. in hydrogen for 6 h. The reduced product was crushed again and sieved by a 120 mesh sieve. The cobalt powder thus prepared contains 0.3% (wt.) yttrium.

The prepared yttrium containing cobalt powder was mixed with those raw materials described above according to following composition: WC 78% (wt.), TiC 14% (wt.), Co 7.88% (wt.), and rare earth metal 0.02% (wt.). The mixture was wet milled in a ball mill for 72 h, followed by adding 2% (wt.) rubber forming agent, shaping by cold pressing, treating at 550° C. in hydrogen to remove the forming agent and sintering at 1460±10° C. under vacuum. The prepared hard alloy contained 0.02% (wt.) yttrium with bending strength and hardness shown in Table 2.

EXAMPLE 3

A solution of cobalt chloride having a gravity of 1.05 g/cm$^3$ was mixed with a solution of cerium nitrate and heated to 35° C., followed by adding, while stirring a solution of ammonium oxalate having a gravity of 1.03 g/m$^3$ and a pH 3. The quantity of ammonium oxalate added was 1.5 mole equivalent per mole equivalent of cobalt chloride and cerium nitrate. The precipitates of cobalt oxalate and cerium oxalate were obtained after reaction and filtrated in a vacuum filtrator to remove the mother liquid, washed by distilled water of 90° C. for 6 times, dried at 200° C., crushed and sieved by a 20 mesh sieve, reduced at 550° C. in hydrogen for 3 h, then crushed again and sieved by a 100 mesh sieve. The prepared cobalt powder contained 0.5% (wt.) cerium.

The prepared cerium containing cobalt powder was mixed with WC powder, cobalt powder, and the powder of (W, Ti)C solid solution obtained from market to further prepare cerium containing hard alloy according to the alloy composition and procedure described in Example 2.

EXAMPLE 4

A solution of cobalt chloride having a gravity of 1.20 g/cm$^3$ containing ammonium chloride was mixed while stirring with a solution of neodymium chloride and heated to 50° C. A stoichiometric equivalent quantity of sodium carbonate solution of 60° C. having a gravity of 1.05 g/cm$^3$ was added to the mixed solution while stirring. The precipitates of cobalt carbonate and neodymium carbonate were obtained after reaction, filtrated in a vacuum filtrator to remove the mother liquid, washed by distilled water of 90° C. for 6 times, dried at 200° C., crushed and sieved by a 20 mesh sieve, reduced at 600° C. in hydrogen for 3 h, then crushed again and sieved by a 100 mesh sieve. The prepared cobalt powder contained 2.8% (wt.) neodymium.

The neodymium containing hard alloy was prepared by using the same raw materials, alloy composition, and procedure, as described in Example 2. The property of the product was listed in Table 2.

EXAMPLE 5

By using the same raw materials and procedure as described in Example 2, a hard alloy without rare earth metal was prepared according to following composition: WC 78% (wt.), TiC 14% (wt.), and Co 8% (wt.). The property of the product is listed in Table 2.

TABLE 2

The properties of hard alloy products containing different rare earth metals.

| | Example | | | |
|---|---|---|---|---|
| | 2 | 3 | 4 | 5 |
| Rare earth metal in hard alloy | Y | Ce | Nd | no |
| Bending strength MPa | 1624 | 1558 | 1681 | 1476 |
| Hardness | 91.2 | 91.4 | 91.4 | 91.0 |

TABLE 2-continued

| The properties of hard alloy products containing different rare earth metals. | | | | |
|---|---|---|---|---|
| | Example | | | |
| | 2 | 3 | 4 | 5 |
| HPA | | | | |

EXAMPLE 6

A solution of cobalt chloride having a gravity of 1.10 g/cm$^3$ was mixed homogeneously with a solution of samarium nitrate having a concentration of 94 mg/ml in a volume proportion of 150:1. The mixed solution was heated to 70° C. A solution of ammonium oxalate having a gravity of 1.15 g/cm$^3$ and a pH value of 5 was added to the mixture while stirring. The quantity of the added ammonium oxalate was 1.7 mole equivalent per mole equivalent cobalt chloride and samarium nitrate. The precipitates of cobalt oxalate and samarium oxalate were obtained after reaction, then filtrated in a vacuum filtrator to remove the mother liquid, washed by distilled water of 90° C. for 6 times, dried at 200° C., crushed and sieved by a 20 mesh sieve, reduced at 530° C. in hydrogen for 4 h, crushed again and sieved by a 100 mesh sieve.

The prepared cobalt powder contained 1% (wt.) samarium.

The prepared samarium containing cobalt powder was mixed and milled with WC powder and Co powder obtained from market according to the following composition: WC 92% (wt.), Co 7.96% (wt.), and Sm 0.04% (wt.). The samarium containing hard alloy was prepared according to the procedure described in Example 1. The product property is listed in Table 3.

EXAMPLE 7

A solution of cobalt nitrate having a gravity of 1.40 g/cm$^3$ was mixed homogeneously while stirring with a solution of praseodymium nitrate having a concentration of 90 mg/ml in a volume proportion of 100:1, and heated to 90° C. A solution oxalic acid having a gravity of 1.05 g/cm$^3$ was added to the mixed solution while stirring. The quantity of oxalic acid added was 2 mole equivalent per mole equivalent cobalt nitrate and praseodymium nitrate. The precipitates were obtained after reaction, then filtrated in vacuum filtrator to remove the mother liquid, washed by deionized water of 90° C. for 6 times, dried at 200° C., crushed and sieved by a 20 mesh sieve, reduced at 480° C. in hydrogen for 6 h, crushed again and sieved by a 100 mesh sieve. The cobalt powder prepared containing 0.8% (wt.) praseodymium.

The praseodymium containing hard alloy was prepared by using same raw materials and procedure as described in Example 6 according to the following composition: WC 92% (wt.), Co 7.96% (wt.), and praseodymium 0.04% (wt.). The product property is listed in Table 3.

EXAMPLE 8

The cobalt powder containing 0.5% (wt.) cerium prepared in Example 3 was used in Example 6 to prepare, through the procedure described in Example 6, a hard alloy having following composition: WC 92% (wt.), Co 7.96% (wt.), and Ce 0.04% (wt.). The produce property is listed in Table 3.

EXAMPLE 9

The cobalt powder and WC powder from market were used as raw materials to prepare, through the procedure described in Example 1, a hard alloy having following composition: WC 92% (wt.) and Co 8% (wt.). The product property is listed in Table 3.

TABLE 3

| | Example | | | |
|---|---|---|---|---|
| | 6 | 7 | 8 | 9 |
| Rare earth metal in alloy, 0.04 wt. % | Sm | Pr | Ce | no |
| Bending strength MPa | 2438 | 2405 | 2382 | 2184 |
| Hardness HRA | 90.0 | 90.1 | 90.0 | 89.6 |

The results in Table 3 show that the hard alloy containing rare earth metal possesses higher bending strength and hardness comparing with the hard alloy without incorporating rare earth metal.

EXAMPLES 10–13

To 2 liters solution of cerium chloride, lanthanium chloride, and yttrium chloride with same rare earth metal content of 10 g/l, 1 kg WC powder from market was added respectively.

The solution mixtures were stirred homogeneously and heated to 30° C. The stoichiometric equivalent quantity of ammonium oxalate was added while stirring. After reaction, the precipitate was filtrated, washed, dried, and reduced at 750° C. in hydrogen for 0.5 h. according to the procedure described in above examples. The tungsten carbide powder thus prepared containing 1% (wt.) rare earth metal.

The WC powder, Co powder, (Ti, W)C powder, and TaC powder obtained from market were used as raw materials to prepare, through the procedure described in Example 2, hard alloys having following compositions respectively: WC 85% (wt.), TiC 3% (wt.), TaC 3% (wt.), Co 8.91% (wt.), and rare earth metal 0.09% (wt.); WC 85% (wt.), TiC 3% (wt.), TaC 3% (wt.), and Co 9% (wt.) (without rare earth metal). The product properties are listed in Table 4.

TABLE 4

| | Example | | | |
|---|---|---|---|---|
| | 10 | 11 | 12 | 13 |
| Rare earth metal in alloy, 0.09 wt. % | Ce | La | Y | no |
| Bending strength MPa | 2058 | 2181 | 1943 | 1842 |
| Hardness HRA | 91.1 | 91.3 | 91.3 | 91.0 |

COMPARATIVE EXAMPLES 1–3

The WC powder, cobalt powder, yttrium powder, and yttrium oxide powder obtained from the market were used as raw materials to prepare, according to the procedure described in Example 1, hard alloys containing Y 0.06% (wt.) (through incorporating yttrium powder or yttrium oxide powder), or not containing yttrium, having following compositions respectively: WC 92% (wt.), Co 7.94% (wt.), and Y 0.06% (wt.); WC 92% (wt.) and Co 8% (wt.). The product properties are listed in Table 5.

TABLE 5

| Method for rare earth incorporation | Bending strength, MPa Comparative Example 1 $Y_2O_3$ | Comparative Example 2 Y | Comparative Example 3 — | Example 1 Co Powder containing Y |
|---|---|---|---|---|
| Bath No. | | | | |
| 1 | 2211 | 2003 | 2206 | 2542 |
| 2 | 2306 | 2479 | 2277 | 2508 |
| 3 | 2452 | 2635 | 2369 | 2477 |
| 4 | 2668 | 2346 | 2239 | 2730 |
| 5 | 2660 | 2671 | 2214 | 2638 |
| Average value | 2459 | 2427 | 2261 | 2579 |
| Enhancement % | 8.7 | 7.3 | — | 14.1 |

THE EFFECTS OF RARE EARTH METAL ON THE MICROSTRUCTURE OF ALLOYS

The morphology observation for alloys and their fracture and the composition and phase structure analysis of the hard alloys prepared in Examples 1, 9, 2, and 5 are performed by using a X-ray diffractor APD 10X, a scanning electron microscope JSM-840 (with an EDM TN 5500), and a transmission electron microscope 2000FX.

Figure 2:
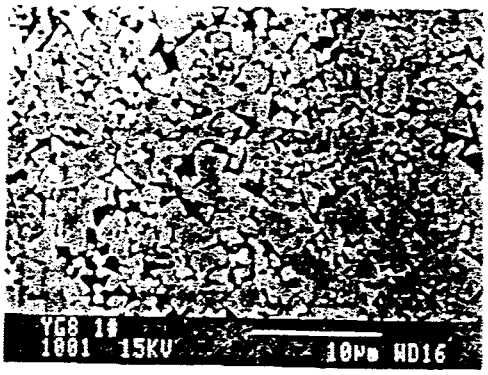
FIG. 2 is the morphology of the alloy prepared in Example 9 observed by SEM.

FIGS. 1 and 2 show the morphology of alloys prepared in Examples 1 and 9 respectively, observed by SEM. The rare earth containing hard alloy prepared according to the process of the invention (FIG. 1) has more homogeneous WC phase comparing with the hard alloy not containing rare earth (FIG. 2). The binder phase in the alloy is silver-like and distributed homogeneously.

Figure 4:
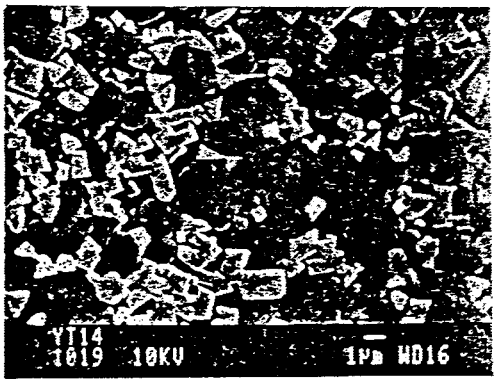
FIG. 4 is the morphology of the alloy prepared in Example 5 observed by SEM.
Figure 3:
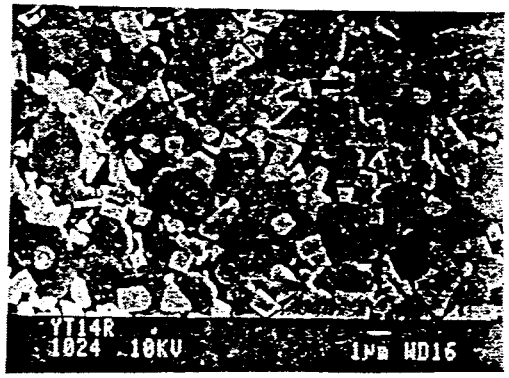
FIG. 3 is the morphology of the alloy prepared in Example 2 observed by SEM.

FIG. 3 and 4 show the morphology of alloys prepared in Examples 2 and 5 respectively, observed by SEM. As shown in the figures, in the rare earth containing hard alloy prepared according to the process of the invention (FIG. 3), the crystalline of (TiW)C is well dispersed. Through the statistics of the measurement in 10 fields of view, the influence of the rare earth metal on the crystalline size of Co, WC, and (TiW)C in the alloy can be compared in Table 6.

TABLE 6

The influence of RE on the crystalline size of Co. WC. and (TiW)C in the alloy

| Alloy | Co crystalline size μm | Co length μm | Co width μm | WC μm | (TiW)C μm |
|---|---|---|---|---|---|
| Example 2 | 0.19 | 0.54 | 0.31 | 0.84 | 1.76 |
| Example 5 | 0.20 | 0.54 | 0.31 | 0.82 | 2.24 |

The results in Table 6 show that in the rare earth containing hard alloy (Ti W)C prepared according to the process of the invention, the crystalline size of (TiW)C phase is obviously smaller, while the crystalline size, length and width of Co as binder phase and the crystalline size of WC phase seem unchanged except that the distribution of their particle size is more concentrated.

Figure 5A:
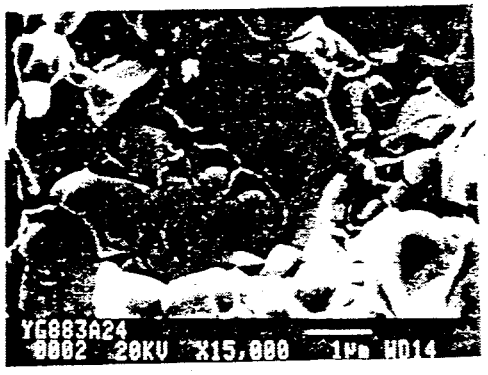
FIG. 5 is the fracture morphology of the alloy displayed in FIG. 1.
Figure 5B:
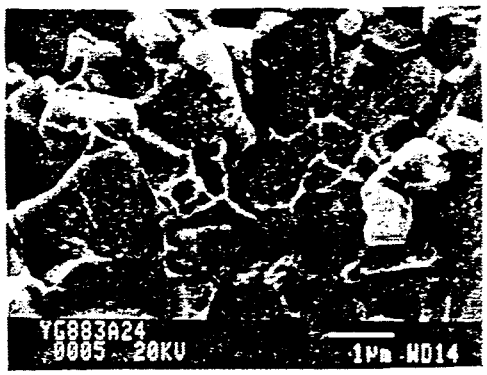
Figure 6:
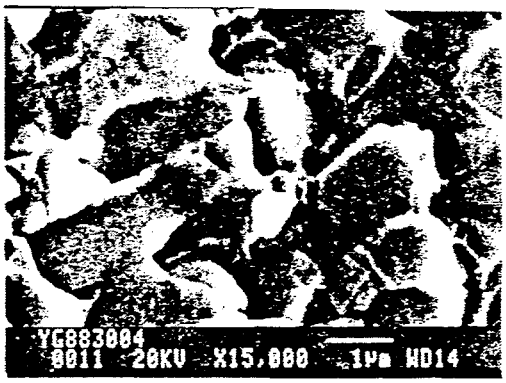
FIG. 6 is the fracture morphology of the alloy displayed in FIG. 2.

FIGS. 5 and 6 show the morphology of the fracture of the alloys displayed in FIGS. 1 and 2 respectively. As shown in FIG. 6, the hard alloy not containing rare earth metal breaks in a typical way of breakage along the crystal edge. In the case of the rare earth containing hard alloy prepared according to the process of the invention, when the breakage occurs along the crystal edge, the plastic deformation of the cobalt phase forms bast-like organization (FIG. 5*a*), and the crack of the crystalline particle of the WC phase forms sector-shape veining pattern (FIG. 5*b*). Hence, the rare earth containing hard alloy prepared according to the process of the invention possesses improved bending strength and shock-resistant performance.

Figure 7:
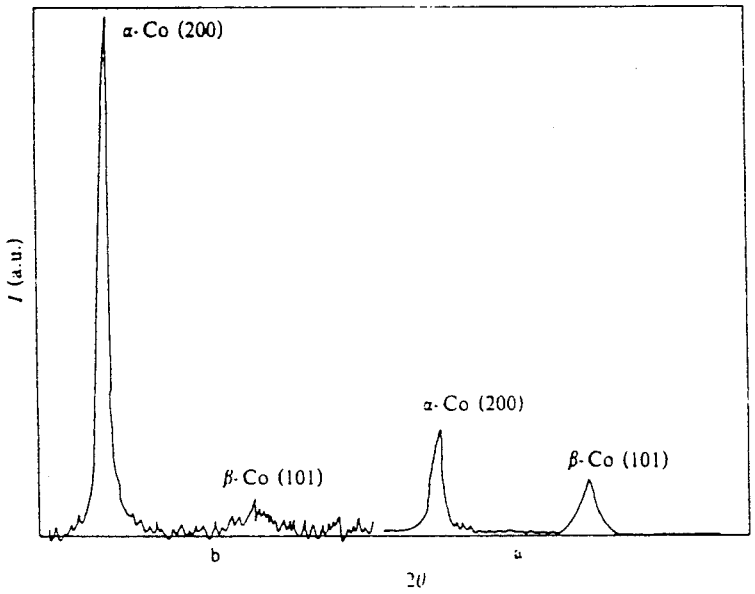
FIG. 7 are XRD patterns of the Co phase of the alloys displayed in FIG. 1 and FIG. 2.

FIG. 7 are XRD patterns of the Co phase of the alloys displayed in FIGS. 1 and 2. The figure shows that in the rare earth containing hard alloy prepared according to the process of the invention (b) the content of the α-Co phase in Co binder phase increases to above 90%, while that in the alloy not containing rare earth (a) is only about 60%. Therefore, the crystalline structure of the Co phase in the rare earth containing hard alloy prepared according to the process of the invention has been changed, resulting in enhancements of the binding strength and the plastic deformation ability of the Co phase.

Figure 8:
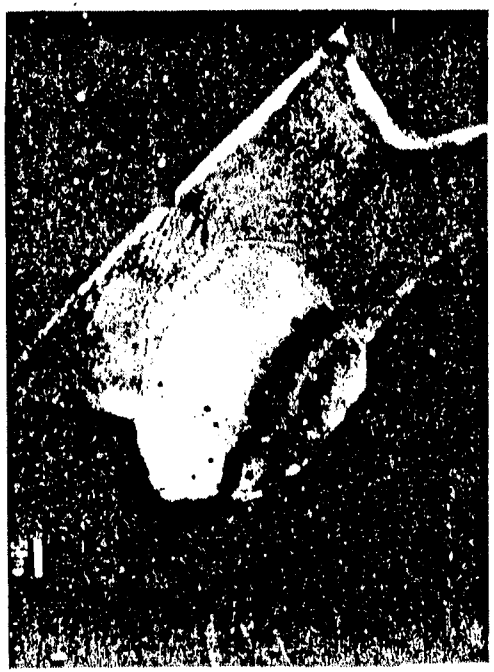
FIG. 8 is the morphology of the interface between WC phase and Co phase in the alloy displayed in FIG. 1, observed by TEM.

As stated above, the incorporation of rare earth metal improves the distribution homogeneity of various phases in the alloy, alters the structure of Co Phase, and hence improves the physical and mechanic properties of the alloy. Moreover, since the presence of impurities such as S, O, and Ca has unfavorable effects on the alloy performance, the incorporation of the rare earth metal into the alloys can suppress these unfavorable effects, FIG. 8 shows the morphology of the interface between the WC phase and Co phase in the alloy displayed in FIG. 1. The figure demonstrates that the rare earth metal exists on the interface between the Co binder phase and WC phase. The results of electron spectroscopy analysis and the electron diffraction pattern prove that the rare earth exists as a compound $RE_2O_2S$. FIG. 8 further displays that the rare earth compound exists as sphere-like particle having a partial size of 0.2 0.5 μm on the interface between the WC phase and Co binder phase. Because the rare earth metal forms compounds with the impurities in the alloy, the crystal boundary is purified and the performance of the hard alloy is improved.

Performance Test

The hard alloys prepared in Example 2 and Example 5 were used to perform the cutting test and shock resistant test for demonstrating the property difference between the hard alloys containing and not containing rare earth metal.

The hard alloys prepared in Example 2 and Example 5 were used to manufacture cutting tools with a model no of 31603C. The cutting performance, abrasion resistance and shock resistance were tested at 3 different speed on a steel piece made of 38CrNi3Mo.

The abrasion extend was measured during the cutting process. The time length needed for different cutting tools to attain a same abrasion extent (0.35 mm) were determined as an indication of the service endurability.

The results are listed in Table 7.

TABLE 7

The endurability of cutting tools made of different hard alloys

| Endurability of cutting tool (min.) | Cutting speed (m/min.) 100 | 120 | 140 |
|---|---|---|---|
| Example 2 | 50.1 | 19.7 | 8 |
| Example 5 | 35.4 | 16.5 | 5.3 |

The shock resistant tests were performed by using a cylinder-shape work-piece with 4 axial surface slots milled by a milling machine. Cutting was carried out at 4 different speeds with 1 mm cutting thickness. The cutting tools subjected to shock 4 times for every turning cycle of the work-piece. The test results are listed in Table 8.

TABLE 8

| Shock resistance | Cutting speed (m/min.) 95 | 100 | 110 | 120 |
|---|---|---|---|---|
| Example 2 | | | | |
| Shock times | 790 | 329 | 887 | 343 |
| tipping | no | no | yes | yes |
| Example 5 | | | | |
| Shock times | 79 | 72 | 42 | 43 |
| tipping | yes | yes | yes | yes |

The results in Table 7 and 8 indicate that the cutting tools made of the rare earth containing hard alloys of the invention possess much higher service endurability and shock resistance than that of the hard alloys not containing rare earth metal.

What is claimed is:

1. A process for preparing rare earth containing hard alloy, comprising:

a) mixing homogeneously a solution of a soluble rare earth metal salt with a tungsten carbide-based powder or a solution of a soluble cobalt salt, adding to the mixture, while heating, a precipitator solution, resulting in a mixture of the tungsten carbide-based powder and the precipitate of the rare earth metal salt or a mixture of the precipitate of the cobalt salt and the precipitate of the rare earth metal salt, filtrating the mixture, washing the filtrate by distilled water or deionized water followed by drying, reducing said precipitates of the cobalt salt and the rare earth metal salt in hydrogen under high temperature, crushing and sieving for making a tungsten carbide-based powder containing rare earth metals or cobalt powder containing rare earth metals;

b) mixing and milling homogeneously the powders of carbide and cobalt, at least one kind of powder from said tungsten carbide-based powder and cobalt powder being the kind of powder containing rare earth metal prepared according to step a;

c) shaping by pressing the mixture obtained from steb b with an organic forming agent, followed by treating under high temperature under vacuum or in reducing gas or in inert gas to eliminate the forming agent, sintering the mixture under high temperature after forming agent elimination and obtaining rare earth containing hard alloy products.

2. A process according to claim 1, wherein said rare earth metal is selected from the group consisting of Y, Ce, La, Sm, Pr, Nd, or a mixture thereof.

3. A process according to claim 1, wherein said rare earth metal salts are selected from the group consisting of nitrates and chlorides thereof.

4. A process according to claim 1, wherein said soluble cobalt salts are selected from the group consisting of nitrates and chlorides.

5. A process according to claim 1, wherein said precipitators are selected from the group consisting of oxalic acid, ammonium oxalate, and sodium carbonate.

6. A process according to claim 1, wherein said metal carbide powder is mixed with the solution of the soluble rare earth metal salt homogeneously and heated to 30°-45° C., followed by adding to the mixture the precipitator solution while stirring, washing and drying the precipitate, and reducing it in hydrogen at 700°-800° C.

7. A process according to claim 1, wherein said solution of the soluble cobalt salt is mixed with the solution of the soluble rare earth metal salt homogeneously and heated to 30°-90° C., followed by adding to the mixture the precipitator solution, washing and drying the precipitate, crushing it, and reducing it in hydrogen at 450°-750° C.

8. A process according to claim 7, wherein the specific gravity of said solution of the soluble cobalt salt is in the range of 1.05-1.40 g/cm$^3$ and that of said precipitator solution is in the range of 1.03-1.20 g/cm$^3$.

9. A process according to claim 7, wherein the quantity of the precipitator used in 1.0-2.0 mole equivalent per mole equivalent cobalt salt and rare earth metal salt.

* * * * *